US005734138A

United States Patent [19]

Goto

[11] Patent Number: 5,734,138

[45] Date of Patent: Mar. 31, 1998

[54] FULLY ENCAPSULATED SWITCH ASSEMBLY INCLUDING NONCONDUCTIVE ELASTOMERIC MATERIAL INTERPOSED BETWEEN NORMALLY OPEN CONTACTS

[75] Inventor: Kazuhiro Goto, Ontario, Canada

[73] Assignee: The Whitaker Corporation, Wilmington, Del.

[21] Appl. No.: 742,223

[22] Filed: Oct. 31, 1996

[51] Int. Cl.[6] ..... H01H 1/50; H01H 3/54

[52] U.S. Cl. ..... 200/16 R; 200/6 R; 200/61.19; 200/506

[58] Field of Search ..... 200/6 R–6 C, 200/16 R–16 F, 11 R–11 TW, 61.19, 506, 511, 5 F, 86 R, 85 R

[56] References Cited

U.S. PATENT DOCUMENTS

| | | | |
|---|---|---|---|
| 4,031,344 | 6/1977 | Pilarski et al. | 200/61.58 B |
| 4,031,348 | 6/1977 | Eberhardt | 200/530 |
| 4,109,118 | 8/1978 | Kley | 200/5 E |
| 4,245,139 | 1/1981 | Orscheln et al. | 200/52 R |
| 4,322,587 | 3/1982 | Burns et al. | 200/5 R |
| 4,352,968 | 10/1982 | Pounds | 200/302.2 |
| 4,405,841 | 9/1983 | Van Zeeland | 200/11 R |
| 4,524,256 | 6/1985 | Miyata et al. | 200/86 R |
| 4,529,959 | 7/1985 | Ito et al. | 200/86 R X |
| 4,623,766 | 11/1986 | Utagawa et al. | 200/85 R |
| 4,707,570 | 11/1987 | Ide et al. | 178/18 |
| 4,876,422 | 10/1989 | Kanezwa | 200/302.1 |
| 4,918,270 | 4/1990 | Orrico | 200/302.2 |
| 5,089,671 | 2/1992 | Ranetkins | 200/5 A |
| 5,120,912 | 6/1992 | Sharp | 200/16 R |
| 5,227,774 | 7/1993 | Benoist | 200/511 X |
| 5,448,028 | 9/1995 | Filion et al. | 200/52 R |
| 5,489,754 | 2/1996 | Dirmeyer et al. | 200/302.1 |

*Primary Examiner*—J. R. Scott

[57] ABSTRACT

The invention comprises a switch assembly having a housing with a recess therein. A first contact has a mating section and is disposed within the recess. A second contact has a deflectable mating section and is disposed within the recess. An elastomeric material encapsulates the first and second contacts within the recess wherein force on the elastomeric material pushes the deflectable mating section of the second contact into electrical engagement with the mating section of the first contact thereby activating the switch.

22 Claims, 3 Drawing Sheets

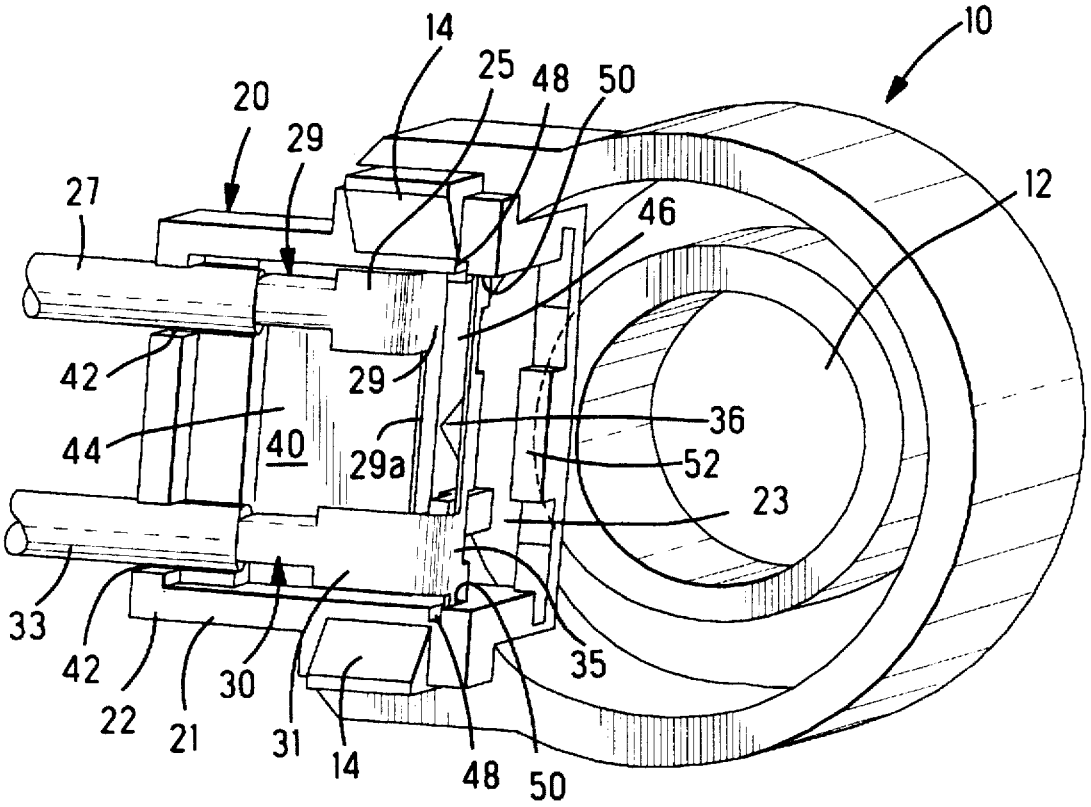
Fig. 1
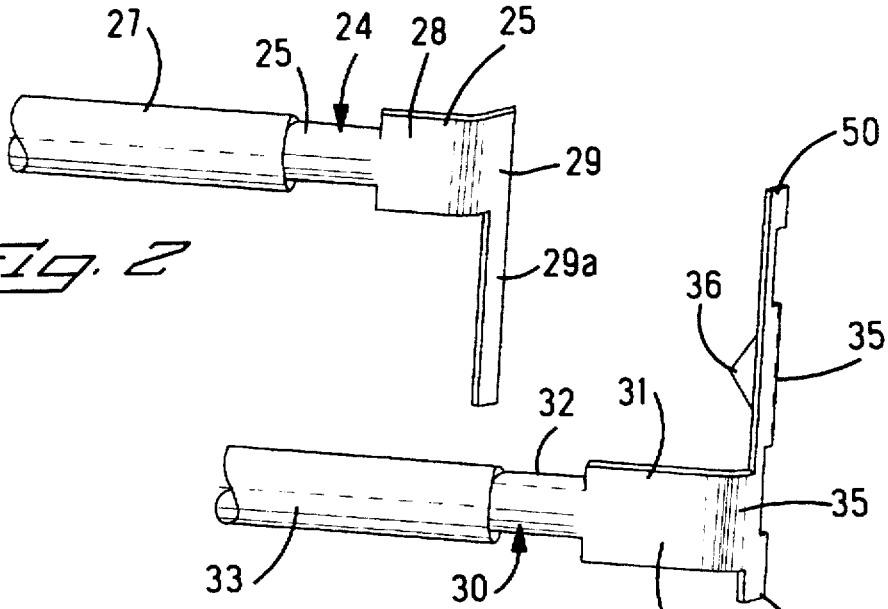
Fig. 2
Fig. 3

FULLY ENCAPSULATED SWITCH ASSEMBLY INCLUDING NONCONDUCTIVE ELASTOMERIC MATERIAL INTERPOSED BETWEEN NORMALLY OPEN CONTACTS

FIELD OF THE INVENTION

The invention is directed to a fully encapsulated switch assembly.

BACKGROUND OF THE INVENTION

Switch assemblies are often enclosed within a sealed housing to protect the assembly from environmental conditions or moisture. The switching contacts are typically placed within a housing positioned such that one of the contacts is moved into contact with the other.

U.S. Pat. No. 4,245,139 discloses a brake cable switch assembly comprising a housing with a flexible top wall. A pair of switch contacts are mounted within a chamber within the housing for operation between a normal first electrical condition and a second electrical condition. The chamber is a hermetically sealed chamber to protect the contact from the environment. The chamber has a seal which extends around the exterior of the chamber to protect the interior of the chamber and the switch contacts from the environment. However, the switch contacts do not have any material disposed between the two of them. There is an air gap disposed between the switch contacts. Further, the assembly is made of different housing parts which require assembly and ultrasonic welding to form the hermetically sealed chamber.

What is needed is a switch assembly in which the switch contacts are protected from each other when in the off position. This switch assembly must also provide protection from the environment. It is also desirable to provide a simplified switch assembly which is simple to manufacture and assemble.

SUMMARY OF THE INVENTION

The invention comprises a switch assembly having a housing with a recess therein. A first contact has a mating section and is disposed within the recess. A second contact has a deflectable mating section and is disposed within the recess. An elastomeric material encapsulates the first and second contacts within the recess wherein force on the elastomeric material pushes the deflectable mating section of the second contact into electrical engagement with the mating section of the first contact thereby activating the switch.

The invention is further directed to a switch assembly having a housing with a contact receiving area. A first contact is disposed within the contact receiving area. A second contact is disposed within the contact receiving area. The second contact has a resiliently deflectable mating section. The resiliently deflectable mating section is movable from a first position out of engagement with the first contact and a second position in which the second contact is in electrical engagement with the first contact. An elastomeric material encapsulates the first and the second material.

BRIEF DESCRIPTION OF THE DRAWINGS

An embodiment of the invention will now be described with reference to the accompanying drawings, in which:

FIG. 1 is an isometric view showing the switch assembly mounted onto an apparatus;

FIG. 2 is an isometric view of one of the contacts of the switch assembly of the present invention;

FIG. 3 is an isometric view of the other contact;

DETAILED DESCRIPTION OF THE INVENTION

Figure 4:
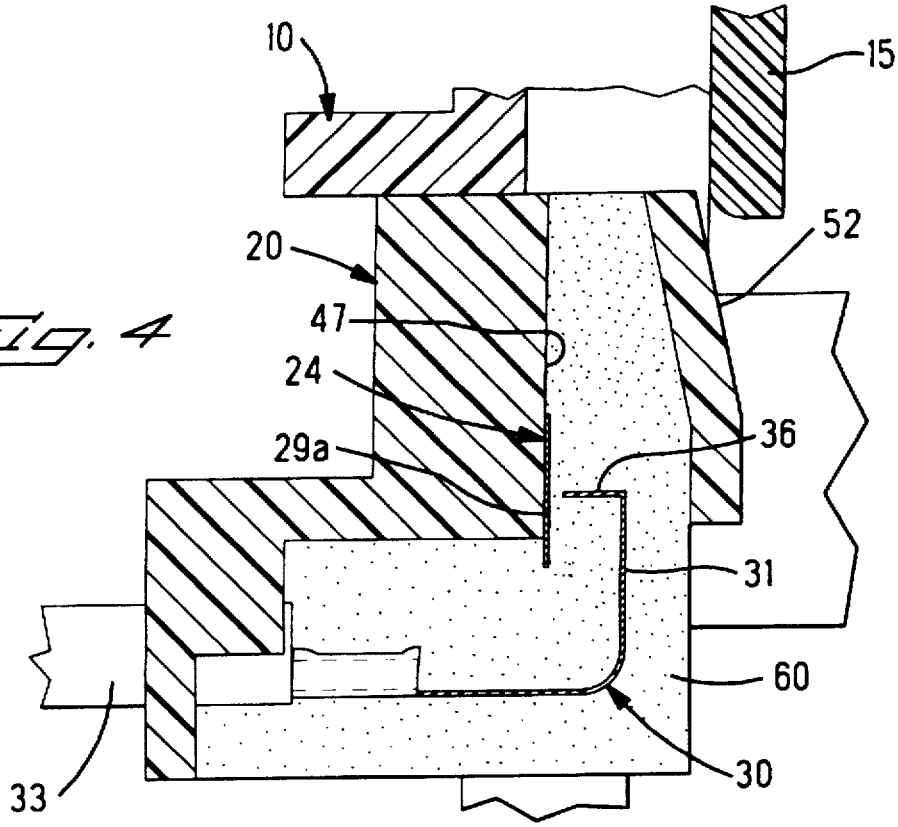
FIG. 4 is a cross-sectional view of the switch assembly in the off position.

FIG. 1 shows the switch assembly 20 of the present invention mounted onto a plug housing 10. The plug housing 10 is a part of an apparatus which requires a drainage plug. The plug housing 10 has a hole 12 which runs from the interior of the apparatus (the portion facing forward in FIG. 1) to the exterior of the apparatus (the opposite face of the plug housing). The plug housing 10 also has a set of latching arms 14 to secure the switch assembly 20 thereto. The switch assembly 20 is shown used in combination with a plug housing 10, however, it is envisioned that the switch assembly could be used with many different types of apparatus.

The plug housing 10 is designed to receive a plug shown in FIGS. 4–7, the plug allows drainage of liquid from the apparatus and it is important that there is some indication that the plug is present within the plug housing before operation of the apparatus. Therefore, in the embodiment shown in FIG. 1, the switch assembly 20 is being used to indicate whether or not the plug is present within the hole 12 in the plug housing 10. The switch assembly 20 of the present invention could either be an integral part of the plug housing 10 or it could be a separate component which is mounted to and latched to the plug housing, as is shown in FIG. 1.

The switch assembly 20 is made up of a housing 22 and two contacts 24, 30. The contacts are best shown in FIGS. 2 and 3. Contact 24 has a mating section 25 and a crimping section 26. The crimping section 26 is used to secure the contact 24 to wire 27. The mating section of the contact has a first portion 28 which is in line with the crimping section 26. The mating section 25 also has a bent portion 29 which is bent at a right angle with respect to a first portion 28. The bent portion 29 also has a finger **29*a*, which is extending downwardly as shown in FIG. 2, and which forms a contact surface. The contact 24 is crimped to the center conductor of wire 27 in the wire crimping section 25, the center conductor is not shown in FIG. 2. The insulation of the wire 27 abuts against the crimping section 25**.

Contact 30 has a mating section 31 and a crimping section 32 for connecting the contact 30 with wire 33. The mating section 31 has a first portion 34 which is in line with the crimping section 32. The mating section has a bent portion 35 which is bent at a right angle to the first portion 34. The bent portion 35 has a finger 35a which extend upwardly as shown in FIG. 3. Contact 30 differs from contact 24 in that contact 30 has a triangular contact point 36. The triangular contact point 36 extends at a right angle from the bent portion 35 back towards the crimping section 32. Contact 30 also has tabs 50 which are used to secure the contact. The interaction of the two contacts will be more fully described later. The contact 30 is crimped to the center conductor of wire 33 in the wire crimping section 32, the center conductor is not shown in FIG. 3. The insulation of the wire 27 abuts against the crimping section 32.

The housing 22 of the switch assembly 20 has a bottom face 21 and an engaging face 23. A recess 30 extends along the bottom face 21 and the engaging face 23 and the contacts 24, 30 are mounted therein. Extending from the recess 40 are two openings 42 in which the wires 27, 33 are received. The openings 42 are slightly smaller than the insulation on the wires 27, 33 so that the insulation is received in an interference fit within the openings 42. This secures the contacts and the wires within the housing prior to the encapsulation process.

The recess has two portions the first portion 44 receives the first portions 28, 34 of the contacts 24, 30. The second portion 46 of the recess is disposed at a right angle to the first portion, is disposed along the engaging face 23, and the second portion 46 receives the front portions 29, 35 of the contacts. Along two walls of the recess 40 are slots 48. The slots 48 will engage the engaging tab 50 on either end of contact 30. The slot 48 will secure and align the contact 30 within the recess. The second portion 46 of the recess has a wall 47 against which the finger 29*a* of contact 24 is received and supported.

Extending across the second portion 46 of the recess 40 is a pusher arm 52. The pusher arm is an integral part of the housing 22 and it is resiliently deflectable. When a force is exerted against the pusher arm it is pressed towards the contacts 30, 24. The recess 40 is fully encapsulated with elastomeric material, not shown in FIG. 1 for simplicity purposes, to completely cover the contacts 24, 30 from the opening 42 around into the second portion 46 to cover the mating sections of the contacts.

FIG. 4 is a side view of the switch assembly 20 mounted to the plug housing 10. In this view, the encapsulation is clearly shown. The encapsulating material 60 is an elastomeric material such as a polyurethane, a thermoplastic polymer, or a silicon rubber. Other materials having appropriate properties could also be used to encapsulate the contacts. The assembly is typically made by first inserting the wires and the contacts into the housing. The contacts are then encapsulated by either an injection molding process and a casting process. It is obvious from the side view that the contacts 24, 30 are fully encapsulated within the elastomeric material thereby protecting them from the environment. The wires 27, 33 extend out of the housing and beyond the encapsulating material. The crimping sections 25, 32 are also fully encapsulated so that only the insulation of the wires 27,33 are exposed to the outside of the assembly. The encapsulating material 60 extends throughout the recess 40 from the first portion 44 into the second portion 46 and is held between the housing 22 and the pusher arm 52.

Figure 5:
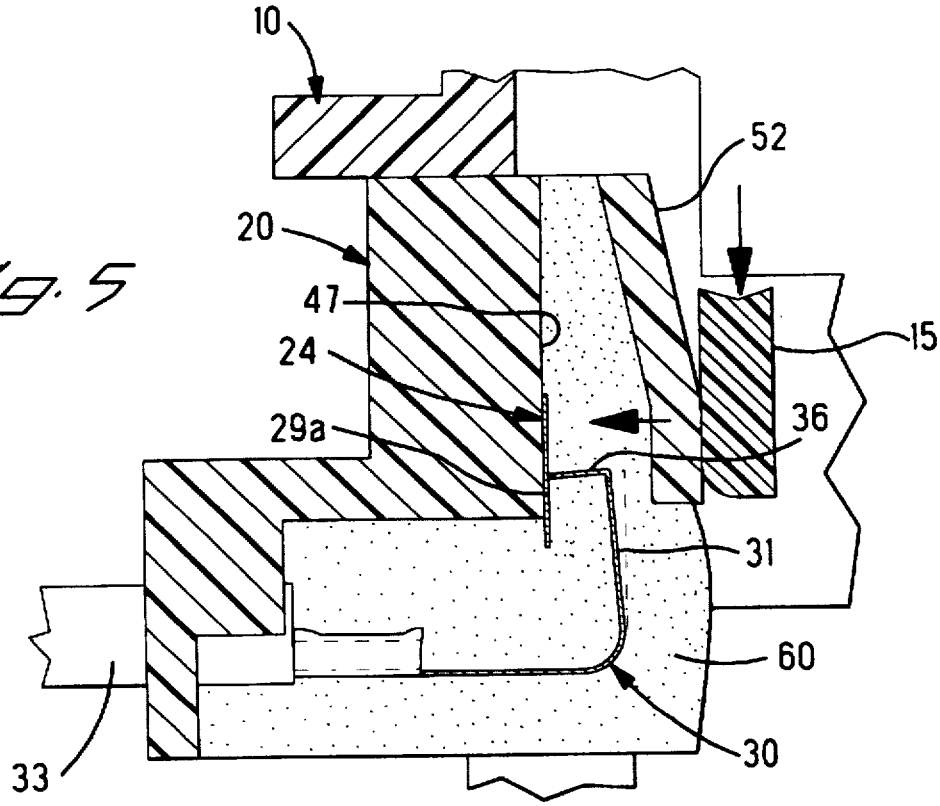
FIG. 5 is a cross-sectional view showing the switch assembly in the activated position.

FIG. 4 shows a portion of the plug 15 as it is being inserted into the plug housing 10. FIG. 5 shows the interaction of the plug 15 with the pusher arm 52. As the plug 15 is inserted into the hole 12, the plug 15 engages the pusher arm and displaces the pusher arm 52 to the left as shown in FIG. 5. In turn the pusher arm 52 pushes on the elastomeric material 60 which pushes on the mating section 31 of the contact 30. Because the contacts are fully encapsulated, the first time the plug 15 engages the pusher arm 52, the triangular contact 36 will cut through the elastomeric material until it touches the finger 29*a* of contact 24 thereby making electrical contact and activating the switch.

Upon removal of the force against the pusher arm 52, such as removing the plug 15 from the plug housing 10, the triangular contact point 36 of the contact 30 will spring back to its normal position because of the force of the elastomeric material 60, thereby deactivating the switch. Upon release of the pusher arm 52 and the springing back of the contact 30, the elastomeric material returns to its normal position and will seal around the contact 30 once again thereby preventing most, if not all, of the air gaps between the contact 30 and the contact 24. When the plug 15 is inserted into the plug housing 10 again, the pusher arm will once again push the triangular contact point 36 of contact 30 into engagement with contact 24 thereby activating the switch. The second time, and any other time subsequent to that, it is not necessary for the contact point 36 to cut through the elastomeric material, as it has already been cut. However, the contact point will push through the elastomeric material compressing the material so that upon release of the plug 15 the contact will once again spring back from contact 24.

Figure 6:
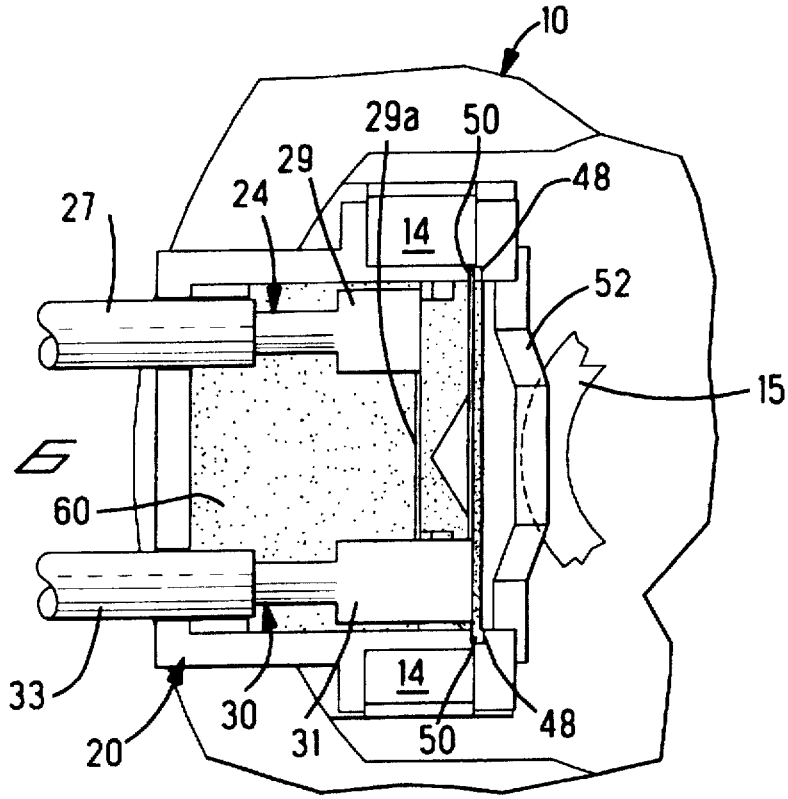
FIG. 6 is a bottom view of the switch assembly in the off position.
Figure 7:
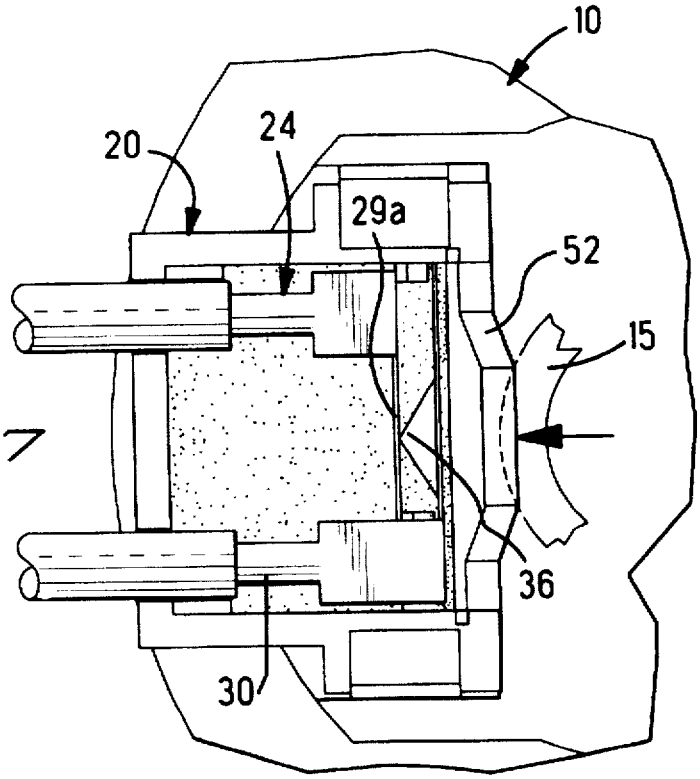
FIG. 7 is a bottom view of the switch position in the activated position.

FIG. 6 shows a bottom view of the switch assembly 20 when the contacts are not making electrical contact. As is obvious here, the contact point 36 is spaced away from the mating section 25 of contact 24 thereby deactivating the switch. As the plug 15 is inserted into the plug housing 10 the plug 15 will put pressure onto the pusher arm 52 which in turn will compress the elastomeric material 60 and push the contact 30 until it comes into electrical engagement with 24. Again when the plug is removed, the pusher arm 52 will spring back thereby releasing the force against the elastomeric material and the contact point 36 will also spring back thereby deactivating the switch.

The present invention allows the user to notified whether the plug is present within the plug housing. If the plug is not present, the switch is deactivated. If the plug is present, the switch is activated, and the user can be alerted to the condition. The switch assembly provides full protection for the contacts against water and other environmental conditions.

The advantage of having the switch assembly fully encapsulated is that the contacts are completely insulated from each other by an elastomeric material. While tiny air gaps may be formed between the contacts, for the most part the contacts are isolated from each other by the insulator or the elastomeric material. Another advantage is that the contacts are completely encapsulated so that they will not corrode or short because of exposure moisture. A further advantage is that the switch assembly can be made in a one step process, the recess can be completely filled with the encapsulating material in one step.

The switch assembly of the present invention and many of its intended advantages will be understood from the foregoing description. It is apparent that various changes may be made in the form, construction, and arrangement of parts thereof without departing from the spirit or scope of the invention, or sacrificing all of its material advantages.

What is claimed is:

1. A switch assembly, comprising:

a housing having a recess therein;

a first contact having a mating section and being disposed within the recess;

a second contact having a deflectable mating section and being disposed within the recess; and an elastomeric material encapsulating the first and second contacts within the recess wherein force on the elastomeric material pushes the deflectable mating section of the second contact into electrical engagement with the mating section of the first contact thereby activating the switch.

2. The switch assembly of claim 1, wherein the elastomeric material is a polyurethane.

3. The switch assembly of claim 1, wherein the elastomeric material is a silicon rubber.

4. The switch assembly of claim 1, wherein the housing has a resiliently deflectable pusher arm, the pusher arm being disposed along an outside surface of the elastomeric material, the pusher arm being proximate to the second contact whereby force on the pusher arm pushes the elastomeric material which in turn pushes the deflectable mating section of the second contact.

5. The switch assembly of claim 4, wherein the second contact has a triangular shaped contact point which is directed at a contact surface on the first contact, when force is exerted against the second contact, the triangular shaped contact point is pushed through the elastomeric material to make electrical contact between the first and the second contacts.

6. The switch assembly of claim 4, wherein the housing has a pair of slots, the second contact having tabs on either end of the deflectable mating section, the tabs being received within the slots to secure and position the second contact within the housing.

7. The switch assembly of claim 5, wherein the recess has a wall, a contact section on the first contact being disposed against the wall to support the contact section.

8. The switch assembly of claim 4, wherein the pusher arm is ramped, where when an article is moved along the pusher arm, the article engages the ramped pusher arm exerting a force against the pusher arm which in turn pushes on the elastomeric material.

9. The switch assembly of claim 1, wherein the second contact has crimping section and a mating section, the mating section having a portion which is bent at a right angle to the crimping section, the mating section having a triangular shaped contact point, the contact point extending from the mating section at a right angle to the mating section, the contact point being directed toward the crimping section.

10. The switch assembly of claim 1, wherein the elastomeric material and the second contact are resilient and spring to their unactivated position upon removal of the force.

11. A switch assembly, comprising:

a housing having a contact receiving area;

a first contact being disposed within the contact receiving area;

a second contact being disposed within the contact receiving area, the second contact having a resiliently deflectable mating section, the resiliently deflectable mating section being movable from a first position out of engagement with the first contact and a second position in which the second contact is in electrical engagement with the first contact; and an elastomeric material encapsulates the first and the second material.

12. The switch assembly of claim 11, wherein the elastomeric material is a polyurethane.

13. The switch assembly of claim 11, wherein the elastomeric material is a silicon rubber.

14. The switch assembly of claim 11, wherein the housing has a resiliently deflectable pusher arm, the pusher arm being disposed along an outside surface of the elastomeric material, the pusher arm being proximate to the second contact whereby force on the pusher arm pushes the elastomeric material which in turn pushes the deflectable mating section of the second contact.

15. The switch assembly of claim 14, wherein the second contact has a triangular shaped contact point which is directed at a contact surface on the first contact, when force is exerted against the second contact, the triangular shaped contact point is pushed through the elastomeric material to make electrical contact between the first and the second contacts.

16. The switch assembly of claim 14, wherein the housing has a pair of slots, the second contact having tabs on either end of the deflectable mating section, the tabs being received within the slots to secure and position the second contact within the housing.

17. The switch assembly of claim 15, wherein the recess has a wall, a contact section on the first contact being disposed against the wall to support the contact section.

18. The switch assembly of claim 14, wherein the pusher arm is ramped, where when an article is moved along the pusher arm, the article engages the ramped pusher arm exerting a force against the pusher arm which in turn pushes on the elastomeric material.

19. The switch assembly of claim 11, wherein the second contact has crimping section and a mating section, the mating section having a portion which is bent at a right angle to the crimping section, the mating section having a triangular shaped contact point, the contact point extending from the mating section at a right angle to the mating section, the contact point being directed toward the crimping section.

20. The switch assembly of claim 11, wherein the elastomeric material and the second contact are resilient and spring to their unactivated position upon removal of the force.

21. The switch assembly of claim 11, wherein the housing has an opening into which wires terminated onto the contacts are received, the wires being slightly larger than the opening so that the wires are received within the opening in an interference fit to secure the wires and the contacts in the proper position for adding the elastomeric material.

22. The switch assembly of claim 21, wherein the contacts have termination sections, the termination sections connecting the wires to the contacts, the termination sections being surrounded by the elastomeric material such that only the wires are exposed outside of the switch assembly.

* * * * *